United States Patent [19]

Weisbach et al.

[11] 4,370,928

[45] Feb. 1, 1983

[54] SHEET FED ROTARY PRESS HAVING AN AUXILIARY GRIPPER SYSTEM ARRANGED BELOW A FEEDING CYLINDER

[75] Inventors: Günter Weisbach, Radebeul; Günter Lucius, Dresden; Dieter Plage, Coswig, all of German Democratic Rep.

[73] Assignee: VEB Kombinat Polygraph "Werner Lamberz" Leipzig, Leipzig, German Democratic Rep.

[21] Appl. No.: 154,303

[22] Filed: May 29, 1980

Related U.S. Application Data

[63] Continuation-in-part of Ser. No. 135,627, Mar. 31, 1980.

[30] Foreign Application Priority Data

Feb. 4, 1979 [DD] German Democratic Rep. ... 211938

[51] Int. Cl.[3] ..... B41F 21/05; B65H 5/10; B65H 5/14

[52] U.S. Cl. ..... 101/242; 101/410; 101/411; 271/268

[58] Field of Search ..... 101/232, 239, 241, 242, 101/246, 409, 410, 411, 183, 184, 233; 271/268, 14, 42, 267, 268, 204, 82, 85, 277, 196

[56] References Cited

U.S. PATENT DOCUMENTS

| | | | |
|---|---|---|---|
| 3,116,923 | 1/1964 | Günther | 271/268 |
| 3,257,109 | 6/1966 | Singh | 271/268 |
| 3,818,827 | 6/1974 | Johne | 101/232 |
| 3,839,959 | 10/1974 | Abenoroth | 101/409 |
| 3,986,713 | 10/1976 | Wirr | 271/268 |
| 4,132,403 | 1/1979 | Weisbach et al. | 101/246 X |
| 4,210,079 | 7/1980 | Raes | 101/246 X |

FOREIGN PATENT DOCUMENTS

| | | | |
|---|---|---|---|
| 2451461 | 5/1976 | Fed. Rep. of Germany | 101/242 |
| 122239 | 9/1976 | German Democratic Rep. | |
| 269602 | 10/1927 | United Kingdom | 101/242 |
| 923605 | 4/1963 | United Kingdom | 271/268 |

*Primary Examiner*—J. Reed Fisher
*Attorney, Agent, or Firm*—Michael J. Striker

[57] ABSTRACT

The sheet fed rotary press includes a feed cylinder cooperating with a feed table extending in a plane situated below and in spaced relationship from the periphery of the feed cylinder. An auxiliary gripper system located under the feed cylinder provides for the transfer of respective sheets from the feed table to the feed cylinder.

6 Claims, 6 Drawing Figures

SHEET FED ROTARY PRESS HAVING AN AUXILIARY GRIPPER SYSTEM ARRANGED BELOW A FEEDING CYLINDER

CROSS REFERENCE TO RELATED APPLICATION

This application is a Continuation-in-Part application of our copending application Ser. No. 135,627, filed Mar. 31, 1980 and entitled SHEET-FED ROTARY PRINTING PRESS WITH BOTTOM-WORKING FRONT-END GRIPPER.

BACKGROUND OF THE INVENTION

The present invention relates in general to a sheet fed rotary printing machine, and in particular to a machine of the type having an auxiliary gripper system under a sheet feeding cylinder. The sheet fed rotary press of this type includes one or more sets of printing cylinders whereby the first or upstream set of cylinders cooperates with a sheet feeding table whereby the sheet from the feeding table is taken over by the auxiliary gripper which accelerates the sheet to the speed of the printing machine and transfers the sheet to the feeding cylinder.

From the DDR Pat. No. 122239 a printing machine is known in which sheets from the feeding table are taken over from below by a rocking auxiliary gripper and transferred against sheet stopping elements on the feeding table. The sheet feeding table and the sheet feeding cylinder in this known printing machine are arranged in such a manner that the plane of the feeding table intersects the circumference of the feeding cylinder. In such a mutual arrangement of the feeding table and the feeding cylinder the sheet is withdrawn from the feeding table downwardly and fed on a considerably curved circular path to the feeding cylinder. Due to the fact, however, that the front stop marks can swing back to the stop line on the feeding table only when the leading edge of the withdrawn sheet has passed the intersection point with path of movement of the front stop marks, which point is below the plane of the feeding table, the timing for the return swing of the front stop mark is disadvantageously influenced by this position of the feeding table. In other words, the operational speed or frequency and the periodic time interval for the alignment of the sheets are limited. It is particularly the shortage of alignment intervals especially in the case of high operational speeds of the printing machine which brings about the disadvantage of inadequate accuracy of the sheet alignment and consequently an impaired quality of the processed sheets.

In addition the strongly curved path of movement of the sheet to the feeding cylinder has the disadvantage that the feeding system cannot process all kinds of feed material and consequently certain kinds of the sheets can be processed only at the lower range of the rotary speeds of the machine.

SUMMARY OF THE INVENTION

It is therefore a general object of the present invention to overcome the aforementioned disadvantages.

More particularly, it is an object of the invention to provide an improved sheet fed rotary press having an auxiliary gripper positioned below the feeding cylinder which provides for a larger angle of rotation of the sheet which enables a more accurate alignment of the sheet on the feeding table.

Another object of this invention is to provide such an improved rotary press in which the position accuracy of sheets arriving into the printing area is increased and consequently the printing quality is improved.

In particular, an object of this invention is to provide such an improved rotary press in which the feeding table is positioned to the feeding cylinder in such a manner that the sheets are taken over from the feed table on a path which is only slightly curved and the cross-section point of the path of the leading edge of the sheet during its feeding by the auxiliary gripper with the path of front stops at the outlet of the feeding table lies above the plane of the feeding table.

In keeping with these objects and others which will become apparent hereinafter, one feature of the invention resides, in a rotary press of the above-described type in the arrangement of the sheet feeding table in a plane which is spaced apart from the periphery of the feeding cylinder.

According to another feature of this invention, the auxiliary gripper system which is located under the feeding cylinder and cooperates with the outlet of the feeding table includes a driving rocker arm supporting for rotation a three-armed lever one arm of which acts as a gripper stop, a second arm acts as a gripper lip and the third arm supports a cam follower cooperating with a rocking cam. The rocking cam is supported for reciprocating movement on the frame of the printing machine.

The gripper lip is pivotably supported on the first arm of the three-armed lever and is connected to a cam follower which cooperates with a second rocking cam pivotably supported on the machine frame for controlling the movement of the gripper lip. The spaced arrangement of the feeding table relative to the periphery of the feeding cylinder has the advantage that the feeding line is promptly cleared from the withdrawn sheet. As a result, the front stops at the outlet edge of the feeding table upon rotation about a small rotary angle can return to the stop line for aligning the subsequent sheet and consequently the interval of the alignment of this sheet corresponds to a substantially larger rotary angle of the auxiliary gripper. This alignment interval is sufficient for an accurate aligning operation even at high rotary speeds of the machine.

Moreover, due to the minute path of travel of the front stops about the reduced rotary angle, the acceleration and the corresponding inertia forces are also substantially reduced.

The relatively small curvature of the path of movement of the sheet during its transfer by the auxiliary gripper has the advantage that a prolonged range of sheet materials can be processed by the printing machine.

The novel features which are considered as characteristic for the invention are set forth in particular in the appended claims. The invention itself, however, both, as to its construction and its method of operation, together with additional objects and advantages, will be best understood from the following description of specific embodiments when read in connection with the accompanying drawing.

DESCRIPTION OF THE PREFERRED EMBODIMENTS

Figure 1:
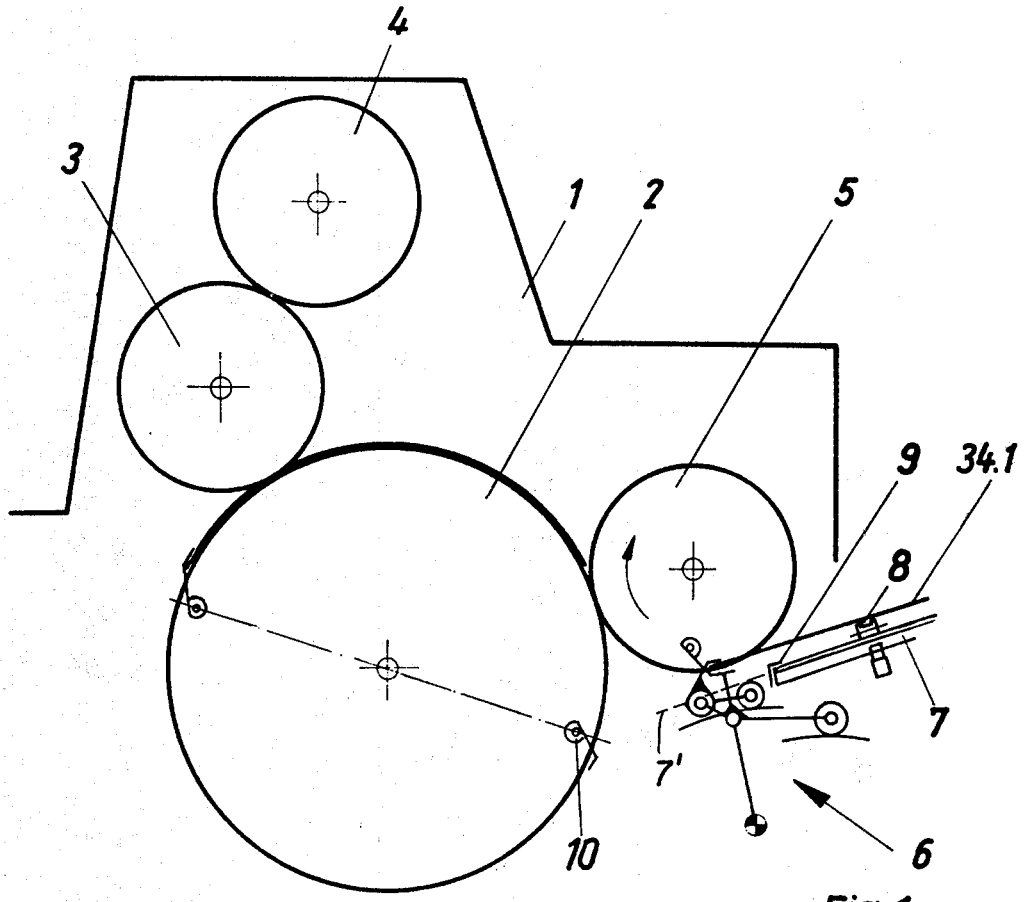
FIG. 1 is a schematic side view of printing cylinders in cooperation with a sheet feeding cylinder, a sheet feeding table and an auxiliary gripper system.

FIG. 1 shows a sheet-fed set 1 of printing cylinders including an impression cylinder 2, a rubber blanket cylinder 3, a plate cylinder 4, a feed cylinder 5 and an auxiliary gripper system 6 cooperating with a feed table 7.

The outlet part of the feed table 7 is arranged below the feed cylinder 5, and is provided with a lateral aligning device 8 and front stops 9 cooperating with the front edge of the feed table. Both the feed cylinder 5 and the impression cylinder 2 are provided on their respective peripheries with clamping grippers 10.

According to this invention, plane 7' of the outlet part of table 7 is spaced apart and directed away from the feed cylinder 5 and sheets from the outlet part are transferred upwardly to grippers 10 by a swinging or rocking movement of the auxiliary gripping system 6.

Figure 2:
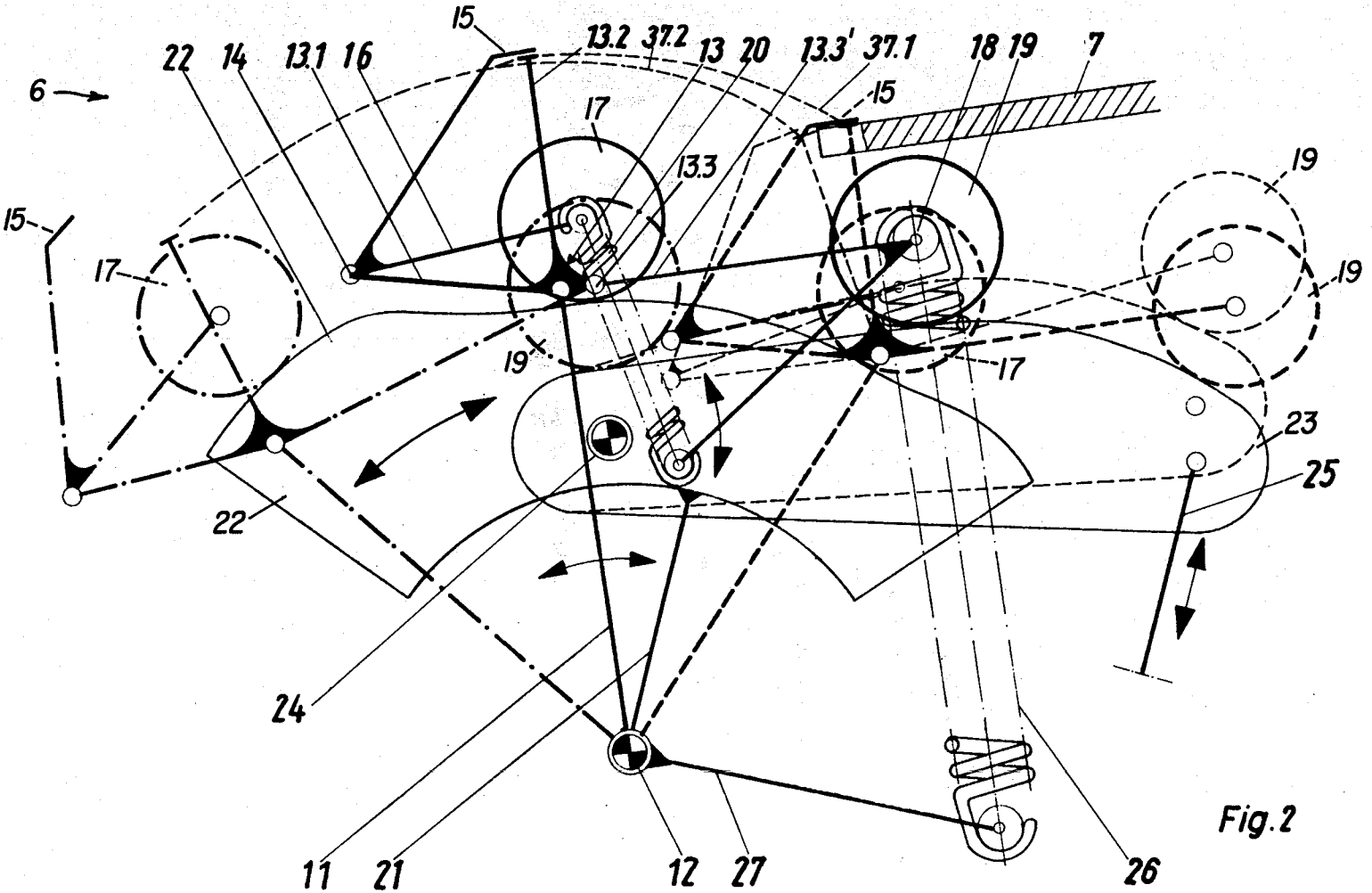
FIG. 2 is a schematic side view of the auxiliary gripper system including the control mechanism and the gripper stop.

Referring now to FIG. 2, the auxiliary gripper system 6 includes a driving rocker arm 11 which is supported for rocking movement on shaft 12 fixedly mounted in the frame of the printing machine. The free end of the rocker arm 11 pivotably supports a three-armed lever 13. The first arm 13.1 of the lever 13 pivotably supports for rotation about shaft 14 the apex of an elbow lever 16. The free end of one arm of lever 16 forms the lip 15 of the auxiliary gripper whereas the other arm of the elbow lever 16 is terminated with a cam follower in the form of a cam roll 17; the second arm 13.2 of the three-armed lever 13 forms the stop for the lip 15 or the auxiliary gripper; and the third arm 13.3 in this embodiment pivotably supports one arm of an elbow lever 13.3' and the apex of the lever 13.3' supports for rotation about pivot pin 18 a cam follower 19. The other arm of the elbow lever 13.3' is connected to the free end of the other arm of lever 16 by a first tension spring 20. The spring 20 pulls the cam follower 17 of gripper 15 lever 16 against a gripper control cam 22 which is supported for an oscillatory movement about the shaft 12 on a support arm 21.

The gripper control arm 22 and its drive is known from prior art and is described for example in the DDR Pat. No. 122 239 and consequently it need not be described in detail.

The cam follower 19 at the apex of lever 13.3' cooperates with an oscillating or rocking arm 23 which is supported for rocking movement about a pivot axle 24, the latter being ridingly mounted in the frame of the printing machine. This second rocking cam 23 is coupled by means of a coupling rod 25 to a conventional reciprocating drive (not illustrated). The cam surface of the second rocking cam 23 in the range of feed table 7 has the form of a circular arc which subsequently transits into the straight cam surface. The pivot pin 18 of the cam follower 19 anchors a second tension spring 26 which at its other end is anchored to a lever arm 27 fixedly connected to the bearing sleeve of the rocker arm 11 on the shaft 12.

Figure 4:
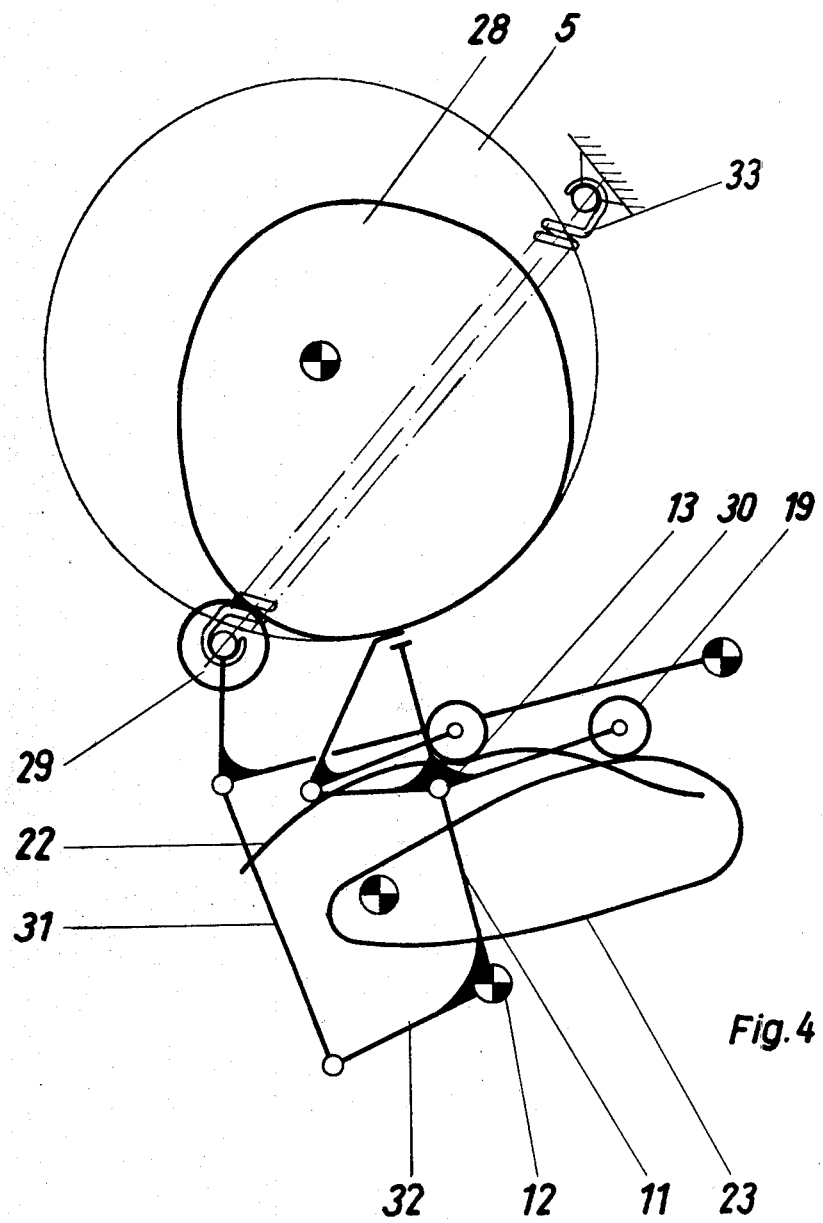
FIG. 4 illustrates schematically the driving mechanism for the auxiliary gripper system.

The drive for the auxiliary system 6 is illustrated in FIG. 4. This drive includes a driving cam 28 mounted on the end face of the feed cylinder 5, a cam follower 29 rotatably supported on one arm of an elbow lever 30 which is hinged on the frame of the machine, a link 31 hinged to the apex of the elbow lever 30 and a driving arm 32 connected to the rocking lever 11 for rotation about the shaft 32 and being hinged at its free end to the link 31.

The cam follower 29 is urged against the cam surface 28 by means of a tension spring 33 connected to the frame of the machine.

Figure 3:
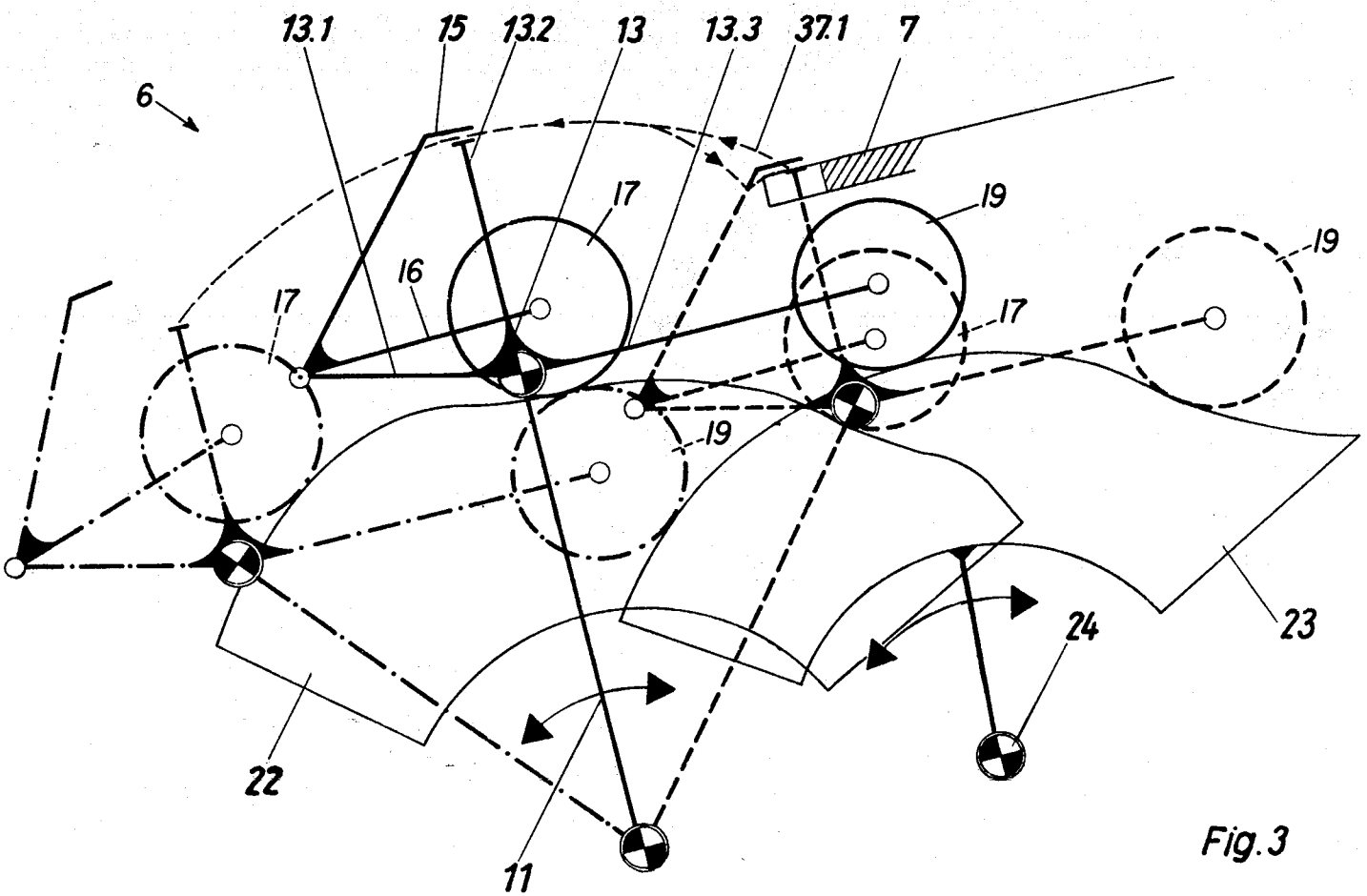
FIG. 3 is a modification of the control mechanism in the auxiliary gripper system of FIG. 2.

A modified version of the control of the auxiliary gripper system 6 is illustrated in FIG. 3. In this embodiment, all three arms 13.1, 13.2 and 13.3 form a fixed angle with each other and the second rocking cam 23 does not perform any additional lifting and lowering movement but instead the whole cam 23 performs a rocking movement about a fixed pin 24. Both rocking cams 22 and 23 have a different profile of their respective cam surfaces in comparison with the embodiment according to FIG. 2.

Figure 5:
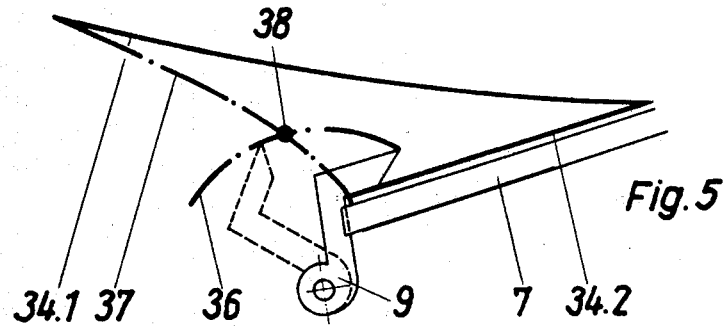
FIG. 5 shows the path of movement of the front stops and the sheets on the feeding table.

The operation of the auxiliary gripper system 6 in the arrangement of the feed table 7 and feed cylinder 5 of this invention is as follows:

From the inlet of the feed table 7, the progressively supplied sheets 34 are fed against front stops 9 at the outlet edge of the table and subsequently are aligned along a side edge of the table by means of the lateral aligning device 8. Upon the alignment of the sheets 34 the front stops 9 which are pivotably supported below the front edge of table 7 swing off the latter whereby the tip of the front stops move along a circular path 36 as indicated by dash- and dot-line in FIG. 5. Immediately before the swing down motion of the front stops 9 the auxiliary gripper 15 and 13.2 seizes the leading sheet 34 while the latter is still in its rest position in abutment with the front stop 9 and upon the release of the sheet by the front marks the gripper system 6 accelerates the sheet and transfers the same to the clamping gripper on the feed cylinder 5 which in turn advances the sheet to the clamping gripper 10 on the impression cylinder 2 where it is printed.

During the transfer of the sheet 34 from the feed table 7 to the feed cylinder 5, the leading edge of the sheet moves along a slightly curved path 37 with a radius of curvature of which is considerably larger than the radius of curvature the path 36 circumscribed by the front stops. The point 38 of intersection of the two paths 36 and 37 is situated a short distance above the plane of the feed table 7 and consequently as soon as the leading edge of the withdrawn sheet passes this intersection point 38, the front stops 9 are free to return to their operative positions in contact with the edge of the feed table 7 to align the subsequent sheet.

The control of the movements in the auxiliary gripper system 6 takes place as follows: The driving cam 57 rotating jointly with the feed cylinder 5, continuously brings via the cam follower 29 the elbow lever 30 into a reciprocating or rocking movement about its pivot point and consequently this rocking movement is transmitted via the link 31 and the arm 32 to the rocking arm 11 so that the latter oscillates in accordance with the shape of the driving cam 28. This rocking movement is also imparted via the three armed lever 13 hinged at the end of rocking lever 11 to the auxiliary gripper lip at the end of the first arm 15 and to the auxiliary gripper stop at the end of the second arm 13.2. The movement of the gripper arm 15 about the gripper shaft 14 is further controlled by the first gripper control cam 22 and the movement of the entire three armed lever 13 is controlled via the cam follower 19 and the lever arm 37.

Figure 6:
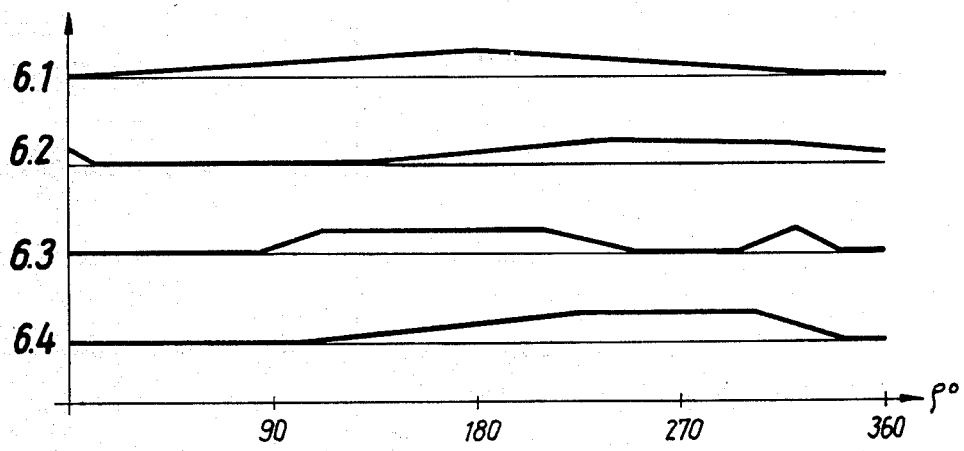
FIG. 6 is a motion diagram of the preliminary gripper and the control mechanism thereof.

Referring now to FIG. 6, there are illustrated different paths of movements of respective control elements of the auxiliary gripper system 6 during one cycle of the rotary press, i.e. when the cylinders move about rotary angle of 360°. In the illustrated path of movement or development of respective control parts, the diagram 6.1 relates to the movements of the auxiliary gripper 15 and 13.2, the diagram 6.2 illustrates the path of the gripper control cam 22, the diagram 6.3 illustrates the relative movement of the gripper lip 15 with respect to the gripper stop 13.2 of the three-armed lever 13, and the diagram 6.4 illustrates the path of movement of the cam surface 23.

As seen from the respective diagrams of FIG. 6, the rocking movement of the whole auxiliary gripper 15 and 13.2 is interrupted only by a short dip at the top of the cam in the position "sheet take over" at the front edge of the feed table 7.

In this operative position as illustrated by dashed lines in FIGS. 2 and 3, the gripper control cam 22 rotates clockwise and the sheet 34 is seized between the gripper stop 30.2 and the lip of the gripper 15. During this take-over position, the second rocking cam 23 takes place in the lower position indicated by a continuous line in FIG. 2. Upon the seizure of the sheet by the gripper lip 15, the gripper system 6 withdraws the sheet 34 along the path 37.1 into a "sheet transfer" operating position as indicated by full lines of arms 11, 12 and 13 in FIGS. 2 and 3. In this transfer position the sheet 30.1 is accelerated to the rocking speed of the machine and is transferred in a conventional manner to the clamping gripper on the feed cylinder 5. As soon as this transfer operation is completed, the lip of the auxiliary gripper 15 opens and releases the transferred sheet 34.1 for advance by the sheet cylinder 5. This operation takes place at about 90° rotary angle of the ETW as seen from FIG. 6. In the course of the movement between operative position "sheet take over" and "sheet transfer" the second rocking cam 23 remains in the lower position while the sheet 34.1 travels along the path 37.1 which is defined by superposition of the swinging movement of the auxiliary gripper 15 and 13.2 about the pivot point at the end of the rocker arm 11 controlled by the movement of the cam follower 19 of the cam surface 23 and the movement of the gripper 15.

Upon the transfer of the sheet at the opening of the gripper lip 15 the gripper movement is accelerated by means of the driving cam 28 rotating at one face of the feed cylinder 5 and the entire auxiliary gropper system 6 is in the operative position "motion reversal" illustrated by dash- and dot-lines in FIGS. 2 and 3 in which its speed is reduced to zero. Alternatively the second rocking cam 23 is swung up to its upper position indicated by dashed lines in FIG. 2 while the cam follower 19 keeps rolling in contact with the cam surface 23.

The superposition of the rocking movement of the second cam 23 and the rolling movement of the cam follower 19 only negligibly affects the control of the three-armed lever 13 during its movement between the phases "sheet take over", "motion reversal", and "transfer/reverse motion".

From the position "motion reversal" the auxiliary gripper system 6 returns via the operative position "sheet transfer" again into the position "sheet take over" and during this return phase the tip of the lip of the gripper 15 travels along the lower path of movement 37.2.

Shortly before attaining the operative position "sheet take over" the second rocking cam 33 is again rotated into its lower position so that the gripper stop 13.2 arrives under the leading edge of the subsequent sheet 34.2 and the gripper lip 15 seized this sheet from above.

The control operation of the modified auxiliary gripper system 6 according to FIG. 3 is substantially similar to that of the embodiment in FIG. 2. The main difference is only in the shape of the lower trajectory 37.2 of the gripper stop 13.2 which as shown in FIG. 3 deviates from the upper trajectory 37.1 only a short distance before arriving to the operative position "sheet take over" at the front edge of the feed table. In other words, in this modified embodiment the gripper stop 13.2 reaches its "sheet transfer" position earlier than in the preceding embodiment and consequently the entire auxiliary gripper system and the feed table can be placed closer to the feeed cylinder 5.

The details of the control means or the gripper control cam 22 which determines the movement of the gripper arm 15 about the gripper shaft 14 need not be disclosed in detail inasmuch as it is well known from prior art and does not form any part of this invention. The gripper system 6 in this example is provided with a mechanical gripper lip cooperating with a gripper stop. It is possible of course to exchange this mechanical gripper for suction grippers moving along the same path of travel.

It will be understood that each of the elements described above, or two or more together, may also find a useful application in other types of constructions differing from the types described above.

While the invention has been illustrated and described as embodied in a specific example of a printing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A sheet fed rotary press comprising at least one set of printing cylinders; a feed cylinder cooperating with said one set; a sheet fed table having an outlet part arranged below said feed cylinder and extending in a plane which is spaced apart and directed away from the periphery of said feed cylinder; a rocking auxiliary gripper system arranged below the feed cylinder for gripping sheets from said outlet part and transferring sheets upwardly toward said feed cylinder; said auxiliary gripper system including a first control cam and a second control cam, a driving rocker arm, a three-armed lever pivotably supported on the rocker arm, an auxiliary gripper having a lip pivotably mounted on a first arm of the lever and a stop formed at the free end of a second arm of the lever, a first cam follower cooperating with the first control cam and being connected to said lip to control the movement of the latter, and a second cam follower rotatably supported on the third arm of the lever and cooperating with the second control cam.

2. A rotary press as defined in claim 1, wherein the second cam follower is arranged on a lever which is pivotably connected to said third arm, and spring means for loading the second cam follower into contact with said second control cam.

3. A rotary press as defined in claim 2, wherein said second control cam is supported for rocking movement about a fixed point.

4. A rotary press as defined in claim 1, further including drive means for said driving rocker arm, the drive means including a driving cam connected to said feed cylinder for joint rotation therewith, a driving cam follower spring biased against the driving cam, and linking means for coupling said driving cam follower to said rocker arm.

5. A rotary press as defined in claim 1, further including front stops provided on said outlet part of the feed table, said front stops being supported for rotation about a pivot point located below the front edge of the outlet part, said front stops moving along a curved path the radius of which is substantially shorter than the radius of curvature of the path of movement of said auxiliary gripper and intersects the latter path of movement at a point located above the plane of the feed table.

6. A rotary press as defined in claim 5, wherein said first and second control cams control together with said driving rocking arm the closing and opening of said auxiliary gripper system.

* * * * *